US008505205B2

(12) United States Patent
Wevers et al.

(10) Patent No.: US 8,505,205 B2
(45) Date of Patent: Aug. 13, 2013

(54) PERSONAL CARE SYSTEM COMPRISING AN ELECTRICAL SHAVER AND A CLEANING DEVICE

(75) Inventors: Dirk Hendrik Wevers, Drachten (NL); Sint Baron, Drachten (NL); Gerben Raap, Drachten (NL); Jan Postma, Drachten (NL); Renger Ypenburg, Drachten (NL); Bastiaan Johannes De Wit, Drachten (NL); Jacob Brinkert, Drachten (NL); Fokke Roelof Voorhorst, Drachten (NL); Klaas Kooijker, Drachten (NL); Alastair Ian Blake, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 824 days.

(21) Appl. No.: 11/573,872

(22) PCT Filed: Jun. 21, 2005

(86) PCT No.: PCT/IB2005/052032

§ 371 (c)(1), (2), (4) Date: Oct. 2, 2008

(87) PCT Pub. No.: WO2006/018745

PCT Pub. Date: Feb. 23, 2006

(65) Prior Publication Data

US 2009/0019702 A1 Jan. 22, 2009

(30) Foreign Application Priority Data

Aug. 19, 2004 (EP) ..... 04103976

(51) Int. Cl.

| | |
|---|---|
| ***B26B 19/38*** | (2006.01) |
| ***B26B 19/14*** | (2006.01) |
| ***B26B 19/28*** | (2006.01) |

(52) U.S. Cl.

USPC ..... 30/41.5; 30/43.4; 30/42

(58) Field of Classification Search

USPC ..... 30/41, 41.3, 34, 528, 537, 41.5, 43.4, 30/42; 134/111, 116, 135, 186, 201, 198, 134/102.3, 23, 24, 92, 183, 104.2; 34/90, 34/202, 218, 237, 201; 132/286, 292; 206/208; 15/104.92

See application file for complete search history.

(56) References Cited

U.S. PATENT DOCUMENTS

| | | | |
|---|---|---|---|
| 1,850,524 | A | 3/1932 | Whittaker |
| 4,442,596 | A | 4/1984 | Nasu et al. |

(Continued)

FOREIGN PATENT DOCUMENTS

| | | |
|---|---|---|
| EP | 664973 | 1/1995 |
| EP | 719203 | 7/1995 |
| WO | 2004086900 | 10/2004 |

*Primary Examiner* — Ghassem Alie

(57) ABSTRACT

A personal care system includes an electrical shaver and a cleaning device for cleaning a shaving head. The cleaning device further includes a displacing system for displacing its supporting member relative to a cleaning fluid container from a first position in which the shaving head, when the shaver is supported by the supporting member, is not in contact with the cleaning liquid in the container, to a second position in which the shaving head is at least partially immersed in the cleaning liquid in the container. The cleaning device does not need any pump for displacing the cleaning liquid. Rather, activation of the shaving head that causes, e.g., rotation of a cutting unit, provides a sufficient pumping effect for the cleaning liquid when the shaving head is immersed in the cleaning liquid.

18 Claims, 4 Drawing Sheets

(56) References Cited

U.S. PATENT DOCUMENTS

| | | | | | |
|---|---|---|---|---|---|
| 5,134,762 | A * | 8/1992 | Scott | 29/26 A |
| 5,614,030 | A * | 3/1997 | Braun | 134/22.1 |
| 5,711,328 | A * | 1/1998 | Braun | 134/111 |
| 7,143,517 | B2 * | 12/2006 | Kappes et al. | 30/538 |
| 7,261,110 | B2 * | 8/2007 | Kappes et al. | 134/92 |
| 7,625,451 | B2 * | 12/2009 | Chasen et al. | 134/10 |
| 2002/0078984 | A1 * | 6/2002 | Hoser et al. | 134/188 |
| 2005/0189003 | A1 * | 9/2005 | Saito et al. | 134/10 |

* cited by examiner

PERSONAL CARE SYSTEM COMPRISING AN ELECTRICAL SHAVER AND A CLEANING DEVICE

The invention relates to a personal care system comprising an electrical shaver and a cleaning device for cleaning a shaving head of the shaver, wherein the cleaning device comprises a container for a cleaning liquid and a supporting member for supporting the shaver.

The invention further relates to a cleaning device suitable for use in a personal care system of the kind mentioned herebefore, the cleaning device comprising a container for a cleaning liquid and a supporting member for supporting an electrical shaver.

The invention also relates to an electrical shaver suitable for use in a personal care system of the kind mentioned herebefore, the shaver comprising a shaving head which comprises at least one cutting unit, said cutting unit being carried by a carrying member which is movable relative to the shaving head from a first position into a second position.

A personal care system and a cleaning device of the kinds mentioned in the opening paragraphs are known from EP-B-0 664 973. The cleaning device of the known personal care system comprises a housing which carries the container for the cleaning liquid and the supporting member for supporting the shaver. The cleaning device further comprises a cradle-shaped receiving portion which accommodates the shaving head of the shaver when the shaver is supported by the supporting member. The receiving portion is positioned above and separate from the container. The cleaning device further comprises a pumping system for pumping cleaning liquid from the container to the receiving portion, and a fan system for blowing air into the receiving portion. In an initial phase of operation of the known cleaning device the receiving portion is empty. After placing the shaver in the cleaning device and activating the cleaning device, a flow of cleaning liquid is generated by the pumping system from the container into the receiving portion and from the receiving portion back into the container. The cleaning liquid flows through the shaving head present in the receiving portion for the purpose of cleaning the shaving head. The cleaning action is enhanced by activating the shaving head of the shaver. The cleaning liquid also flows through a filter-to-filter out dirt particles and debris from the cleaning liquid. After a predetermined cleaning period the pumping system is switched off. The cleaning liquid will then flow back into the container under the influence of gravity forces, because the receiving portion is located above the container. Subsequently the fan system is activated for the purpose of drying the shaving head during a predetermined drying period. In this manner the shaving head of the shaver will be both clean and dry, i.e. ready for immediate use after treatment by the known cleaning device.

A disadvantage of the known personal care system and the known cleaning device thereof is that it comprises a rather complex system for manipulating the cleaning liquid. A considerable chance of malfunction of the cleaning device is present as a result of a considerable risk of obstructions in the pumping system caused by accumulating dirt and debris and as a result of a possible risk of leakage of cleaning liquid at positions where parts of the pumping system are connected to each other.

It is an object of the present invention to provide a personal care system, a cleaning device and an electrical shaver of the kinds mentioned in the opening paragraphs, with which the result of a cleaning treatment is also a clean and dry shaving head, but with which the chance of malfunction of the cleaning device is considerably reduced.

In order to achieve this object a personal care system in accordance with the invention and a cleaning device in accordance with the invention are both characterized in that the cleaning device comprises a displacing system for displacing the supporting member relative to the container from a first position in which the shaving head, when in operation the shaver is supported by the supporting member, is not in contact with the cleaning liquid in the container, to a second position in which the shaving head, when in operation the shaver is supported by the supporting member, is at least partially immersed in the cleaning liquid in the container.

In the cleaning device according to the invention the cleaning liquid is not pumped from the container to the shaving head as in the prior art cleaning device mentioned before, but the shaver carrying the shaving head is displaced into the container and immersed at least partially into the cleaning liquid present therein by means of said displacing system. Thus in the cleaning device according to the invention the cleaning liquid is only stationarily held in the container, and the cleaning device does not need to have a pumping or other kind of transport system for the cleaning liquid. As a result the risk of obstructions in the cleaning device caused by accumulating dirt and debris and the risk of leakage of cleaning liquid from the cleaning device are considerably reduced, so that the chance of malfunction of the cleaning device is also considerably reduced. Since in operation, in said first position of the supporting member, the shaving head is not in contact with the cleaning liquid in the container, the shaving head, after being cleaned, can be brought in a position out of contact with the cleaning liquid by means of the displacing system, so that in this position an effective drying process of the shaving head is possible. In said second position of the supporting member, the shaving head is at least partially immersed in the cleaning liquid. It appeared that activation of the shaving head in this position will lead to a flow of cleaning liquid into the shaving head which is large enough for most types of shavers to obtain a sufficient cleaning result. Accordingly the cleaning device in accordance with the invention also provides a clean and dry shaving head as a result of the total treatment process.

A particular embodiment of a personal care system in accordance with the invention is characterized in that, when in operation the shaver is supported by the supporting member, in said first position the shaving head is above a predefined level of cleaning liquid in the container, and in said second position the shaving head is at least partially below said predefined level. In this embodiment the supporting member is displaceable by the displacing system in a vertical or approximately vertical direction, so that a necessary distance of displacement between the first and second positions of the supporting member is relatively small.

A particular embodiment of a personal care system in accordance with the invention is characterized in that the shaving head comprises at least one cutting unit having an external cutting member and an internal cutting member which is rotatable relative to the external cutting member by means of an electrical driving unit. It appeared that a shaving head of this type provides a very effective flow of cleaning liquid through the shaving head when the shaving head is immersed in the cleaning liquid and activated, so that a good cleaning result is obtained. Said flow of cleaning liquid is the result of an effective pumping action of the rotating internal cutting member. The pumping action can further be enhanced by providing the internal cutting member with hydrodynamically shaped portions.

A particular embodiment of a personal care system in accordance with the invention is characterized in that the shaving head comprises at least one exit opening for the cleaning liquid. By providing the shaving head with said exit opening, a circulating flow of the cleaning liquid is obtained from the container, through the shaving head, and back again into the container when the shaving head is immersed in the cleaning liquid and activated. Dirt and debris released from the shaving head by the circulating cleaning liquid can for example be filtered out from the cleaning liquid in the container.

A further embodiment of a personal care system in accordance with the invention is characterized in that the shaving head comprises at least one cutting unit which is carried by a carrying member which is movable relative to the shaving head from a first position into a second position, wherein the carrying member comprises the exit opening, and wherein the exit opening is in a retracted covered position relative to the shaving head in said first position of the carrying member and in an exposed uncovered position relative to the shaving head in said second position of the carrying member.

An electrical shaver in accordance with the invention is characterized in that the carrying member comprises an exit opening for a cleaning liquid, wherein the exit opening is in a retracted covered position relative to the shaving head in said first position of the carrying member and in an exposed uncovered position relative to the shaving head in said second position of the carrying member.

In this embodiment the carrying member of the shaving head is for example pivotable from said first position into said second position under the influence of skin contact forces, so that the cutting unit will follow the skin contours when the shaving head is moved over the skin. The position of the exit opening will preferably be such that during normal operation of the shaver, when the carrying member will mostly be in said first position or in a position between said first and second positions under the influence of the skin contact forces, the exit opening is covered or mostly covered to prevent dirt and debris form escaping via the exit opening. Preferably the exit opening is uncovered only when the carrying member is in or very close to said second position, and the cleaning device is provided with for example a contact member which holds the carrying member in its second position when the supporting member is in its second position with the shaving head being immersed in the cleaning liquid.

A yet further embodiment of a personal care system in accordance with the invention is characterized in that the supporting member comprises a receiving portion for accommodating the shaving head when the shaver is supported by the supporting member, said receiving portion having a contact member for holding the carrying member in its second position when the shaving head is accommodated in the receiving portion. In this embodiment the carrying member of the shaving head is automatically brought and held in its second position, so that the exit opening provided in the shaving head is uncovered, when the shaver is placed in the cleaning device.

A particular embodiment of a personal care system in accordance with the invention is characterized in that the cleaning device comprises a closing member for closing the container at least in the first position of the supporting member. By closing the container in the first position of the supporting member, evaporation of the cleaning liquid from the container is limited as much as possible.

A further embodiment of a personal care system in accordance with the invention is characterized in that in the first position of the supporting member the closing member is held in a closed position by means of a mechanical spring, and that in the second position of the supporting member the closing member is held in an opened position by means of a contact member. In this embodiment the closing member is automatically opened when the supporting member is displaced from its first position into its second position, and the closing member is automatically closed again when the supporting member is displaced back again from its second position into its first position.

A particular embodiment of a personal care system in accordance with the invention is characterized in that the cleaning device comprises a fluid sensor for detecting the cleaning liquid. The fluid sensor is for example a fluid level sensor for measuring an actual level of the cleaning liquid in the container. The sensor can be used to provide a signal to a control unit of the cleaning device which controls the displacing system, wherein the control unit determines the second position of the supporting member as a function of the measured actual level of the cleaning liquid. In this manner the second position of the supporting member is automatically adapted to the actual level of the cleaning liquid in the container, which may vary as a result of evaporation of the cleaning liquid or inaccurate filling by the user. In this way the shaving head will always be brought in a correct position relative to said actual level.

A further embodiment of a personal care system in accordance with the invention is characterized in that the supporting member comprises a receiving portion for accommodating the shaving head when the shaver is supported by the supporting member, wherein the fluid sensor is mounted to the receiving portion. In this embodiment, the displacement of the supporting member from its first position towards the cleaning liquid in the container is automatically stopped when the fluid sensor detects the presence of cleaning liquid. In this manner the control of the displacing system is considerably simplified. The exact end position of the shaving head relative to the actual level of the cleaning liquid is determined by the position of the fluid sensor on the receiving portion accommodating the shaving head, so that said end position is very accurate.

A particular embodiment of a personal care system in accordance with the invention is characterized in that the container comprises a bottom having a sedimentation portion with partition walls. It appeared that in a circulating flow of cleaning liquid in the container, caused by the pumping action of the activated shaving head, an effective separation of dirt and debris from the cleaning liquid takes place by sedimentation under the influence of gravity forces. The separated dirt and debris will be accumulated between the partition walls of the sedimentation portion. The partition walls prevent the accumulated dirt and debris from re-entering again in the circulating flow. The sedimentation portion provides a very simple structure of the container without the need of an additional filter element, so that the risk of obstructions of the cleaning device by dirt and debris is further reduced.

A particular embodiment of a personal care system in accordance with the invention is characterized in that the supporting member comprises a holder for receiving and holding a housing or a grip portion of the shaver. By means of said holder the shaver is firmly supported in the cleaning device.

A particular embodiment of a personal care system in accordance with the invention is characterized in that the supporting member defines a receiving space for accommodating the shaving head when the shaver is supported by the supporting member, wherein the cleaning device comprises an air flow generating system for generating an air flow in the receiving space in the first position of the supporting member. By means of said air flow the shaving head is effectively dried in a relatively short time period, after being cleaned and being displaced out of the cleaning liquid back into said first position.

A particular embodiment of a personal care system in accordance with the invention is characterized in that the cleaning device comprises an electrical control unit for activating, after activation of the cleaning device by a user, the displacing system to displace the supporting member from its first position into its second position, for subsequently, after a predetermined cleaning period, activating the displacing system to displace the supporting member from its second position back into its first position, and for activating the shaver at least in the second position of the supporting member. Said control unit provides a fully automatic operation of the cleaning device. The user just needs to place the shaver onto the supporting member and to activate the cleaning device. The activation of the shaver in the second position of the supporting member can also be controlled by the control unit by providing an electrical connection between the control unit and the shaver, wherein said connection is for example automatically established when the user places the shaver into the cleaning device.

Embodiments of a personal care system, a cleaning device and an electrical shaver in accordance with the invention will be described in detail in the following description with reference to the drawings, in which FIG. 1 shows a first embodiment of a personal care system according to the invention;

Figure 1:
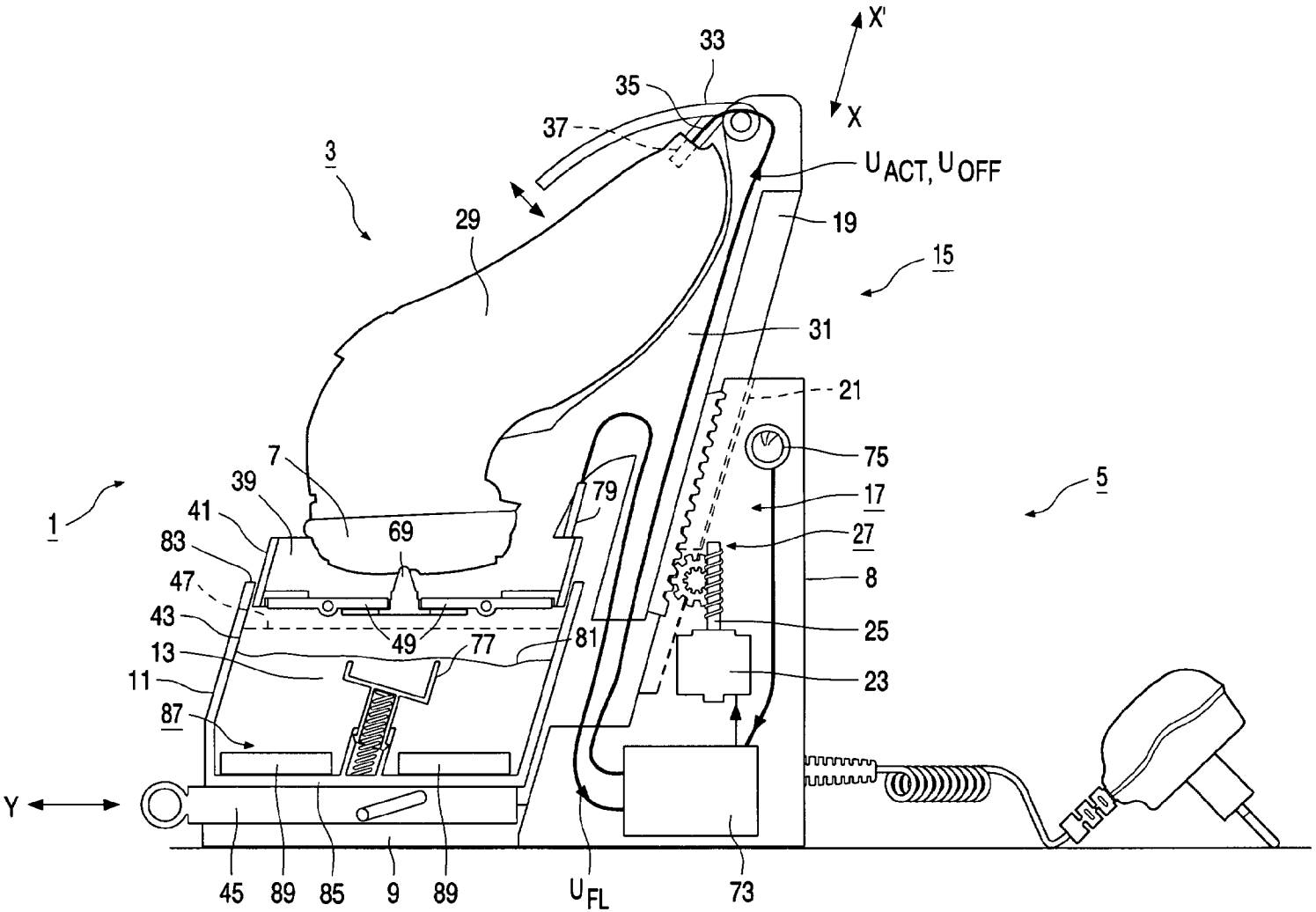

The personal care system 1 according to the invention shown in FIG. 1 comprises an electrical shaver 3 in accordance with the invention and an automatical cleaning device 5 in accordance with the invention for cleaning a shaving head 7 of the shaver 3. In FIG. 1 the shaver 3 is shown in a position in the cleaning device 5. The shaver 3 can be placed in the cleaning device 5 and taken out of the cleaning device 5 by a user of the personal care system 1 in a manner to be described in detail in the following. In the embodiment shown the shaver 3 is a shaver of a kind known from EP-B-0 719 203. Details of the shaver 3 will be described in the following.

The cleaning device 5 comprises a housing 8 comprising a base portion 9. The cleaning device 5 comprises a container 11 for a cleaning liquid 13 which is arranged on the base portion 9. The cleaning device 5 further comprises a supporting member 15 for supporting the shaver 3 in the cleaning device 5. The supporting member 15 is displaceable relative to the housing 8 and the container 11 by means of a displacing system 17. The displacing system 17 comprises a rectilinear guiding member 19, which is provided on the supporting member 15, and a further rectilinear guiding member 21, which is provided in the housing 8 for co-operation with the guiding member 19. The displacing system 17 further comprises an electrical motor 23 with an output shaft 25, and a mechanical transmission system 27 for converting a rotational motion of the output shaft 25 into a rectilinear motion of the supporting member 15 along the further guiding member 21. Thus the supporting member 15 is displaceable by means of the displacing system 17 in approximately vertical and mutually opposed directions X and X' parallel to the further guiding member 21.

The shaver 3 comprises a housing or grip portion 29 which carries the shaving head 7. The supporting member 15 comprises a holder 31 for receiving and firmly holding the grip portion 29. The shaver 3 is releasably latched in the holder 31 by means of a latching member 33, which is only schematically shown in FIG. 1 and which can be operated by the user when placing the shaver 3 into the supporting member 15 or removing the shaver 3 from the supporting member 15. The latching member 33 comprises an electrical contact member 35 which is electrically connected to an electrical contact member 37 of the shaver 3 in a latched position of the latching member 33. The supporting member 15 further comprises a receiving portion 39 which accommodates the shaving head 7 when the shaver 3 is supported by the supporting member 15. In the embodiment shown in FIG. 1 an outer circumferential wall 41 of the receiving portion 39 matches an inner wall 43 of the container 11, a relatively small gap being present between said circumferential wall 41 and said inner wall 43 to limit the escape of cleaning-liquid vapor via said gap in order to limit evaporation of the cleaning liquid 13. To remove the container 11 from the cleaning device 5 the user has to remove a locking plate 45 in horizontal direction Y, after which the container 11 can be lowered and also removed in said horizontal direction Y.

FIG. 1 shows the supporting member 15 of the cleaning device 5 in a first position. When in said first position the shaver 3 is supported by the supporting member 15 and consequently the shaving head 7 is accommodated in the receiving portion 39, the shaving head 7 is above a predefined level 47 of the cleaning liquid 13 in the container 1, so that the shaving head 7 is not in contact with the cleaning liquid 13 in the container 11. Said predetermined level 47 is for example a maximal level up to which the user has to fill the container 11 with the cleaning liquid 13 before use. In said first position of the supporting member 15 no cleaning liquid 13 is present in the receiving portion 39. Consequently in this position the user can place and latch the shaver 3 into the cleaning device 5 without spilling of cleaning liquid 13. As shown in FIG. 1 the receiving portion 39 comprises two plate-shaped pivotable closing members 49 for closing the container 11 in the first position of the supporting member 15. In said first position the closing members 49 are held in closed positions as shown in FIG. 1 by means of mechanical springs which are not shown in FIG. 1 for the sake of simplicity. In this manner the escape of cleaning-liquid vapor via the receiving portion 39 is prevented in the first position of the supporting member 15 in order to further limit the evaporation of the cleaning liquid 13.

Before discussing further details of the cleaning device 5, first a number of details of the shaver 3 will be discussed necessary to understand the operation of the cleaning device 5. In the embodiment shown in FIG. 2 the shaving head 7 of the shaver 3 comprises three cutting units 51. Each cutting unit 51 comprises an external cutting member 53 comprising an annular portion with hair entrance slits 57, and an internal cutting member which is not visible in FIG. 2. The internal cutting member is rotatable relative to the external cutting member 53 by means of an electrical driving unit of the shaver 3. The internal cutting member comprises a crown of cutting elements which are positioned immediately below the annular portion with the slits 57. For further details of the cutting units 51 and the operation thereof reference is made to the EP-B-0 719 203.

Each cutting unit 51 of the shaving head 7 is carried by a carrying member 59 which is movable relative to the shaving head 7. In the embodiment shown in FIG. 2 each carrying member 59 is pivotable relative to the shaving head 7 from a first extreme position, in which the carrying member 59 extends substantially parallel to an upper surface 61 of the shaving head 7, into a second extreme position shown in FIGS. 2 and 3, in which the carrying member 59 is tilted about an angle α relative to said upper surface 61. The tilting motions of the three carrying members 59 are mutually coupled in a manner described in detail in the EP-B-0 719 203. In operation the carrying members 59 are commonly tiltable under the influence of contact forces between the external cutting members 53 and a skin portion 63 as shown in FIG. 3, so that the cutting units 51 follow the contours of said skin portion 63 when the shaving head 7 is moved over the skin.

Figure 2:
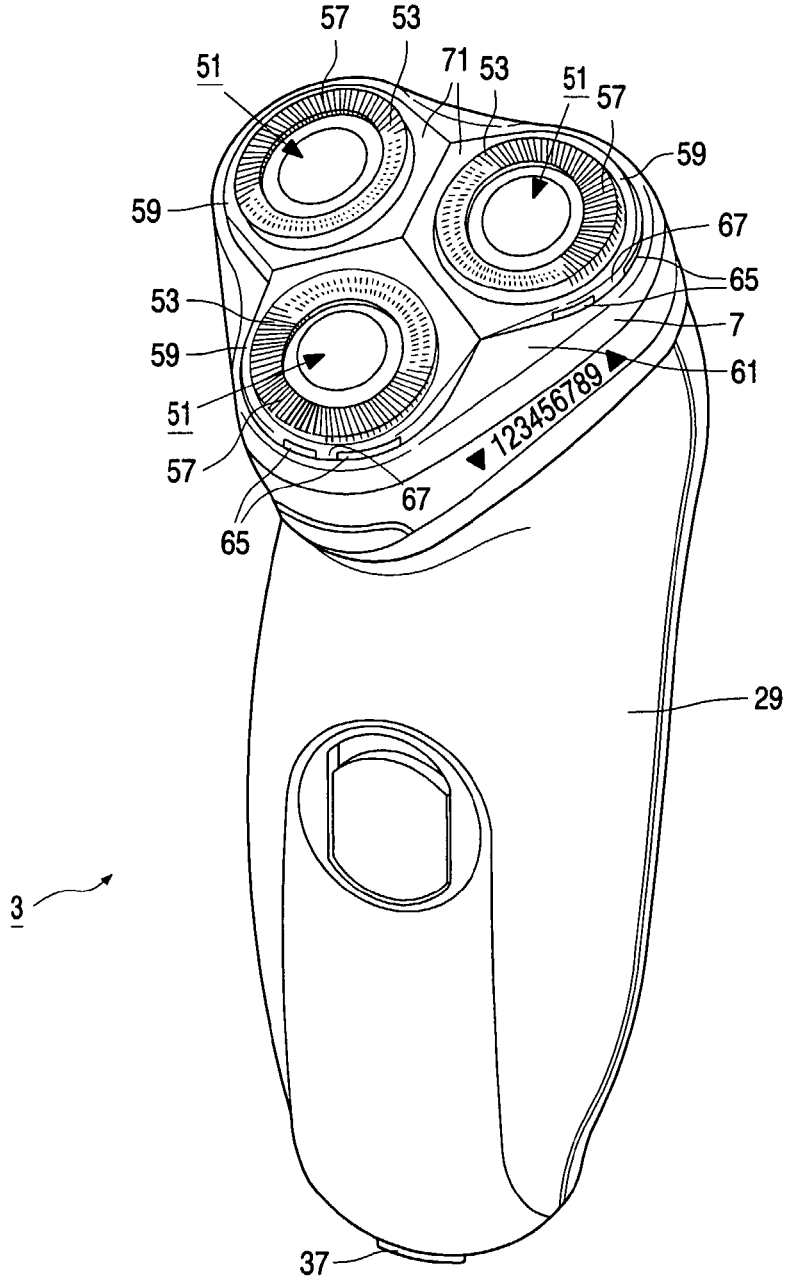
FIG. 2 shows an electrical shaver in accordance with the invention of the personal care system shown in FIG. 1.
Figure 3:
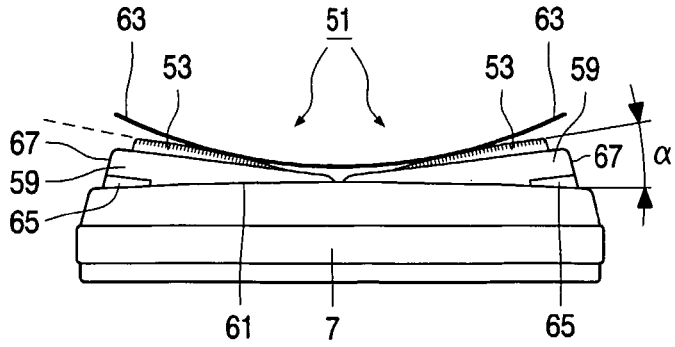
FIG. 3 shows a side view of a shaving head of the shaver shown in FIG. 2.

As shown in FIGS. 2 and 3 the carrying members 59 of the shaving head 7 each comprise a number of exit openings 65 for the cleaning liquid. The function of the exit openings 65 will be discussed in the following. The exit openings 65 are provided on outwardly directed circumferential portions 67 of the carrying members 59. The positions of the exit openings 65 on said circumferential portions 67 are such that in the first extreme positions of the carrying members 59, wherein the carrying members 59 extend parallel to the upper surface 61 of the shaving head 7, the exit openings 65 are each in a retracted covered position relative to the upper surface 61, and that in the second extreme positions of the carrying members 59, wherein the carrying members 59 are in their extreme tilted positions relative to the upper surface 61, the exit openings 65 are each in an exposed uncovered position relative to the upper surface 61 as shown in FIGS. 2 and 3. The positions of the exit openings 65 are preferably such that during normal operation of the shaving head 7, when the carrying members 59 will mostly be in their first positions or in positions between their first and second positions under the influence of the skin contact forces, the exit openings 65 are covered or mostly covered to prevent that dirt and debris accumulated in the shaving head 7 can escape via the exit openings 65. Thus, preferably the exit openings 65 are uncovered only when the carrying members 59 are in or close to their extreme tilted positions.

Returning now to the details of the cleaning device 5, FIG. 1 shows a contact member 69 which is centrally provided in the receiving portion 39. When the shaver 3 is supported by the supporting member 15 and consequently the shaving head 7 is accommodated in the receiving portion 39, the contact member 69 abuts against a central portion 71 of each of the three carrying members 59 shown in FIG. 2. As a result the carrying members 59 are each held in their second positions, so that the exit openings 65 are in their exposed uncovered positions.

The cleaning device 5 further comprises an electrical control unit 73 which automatically controls the operation of the cleaning device 5 in the following manner. After placing the shaver 3 in the cleaning device 5 as described before, the user can activate the cleaning device 5 by pressing a start button 75. Upon activation of the cleaning device 5 the control unit 73 activates the motor 23 of the displacing system 17 to displace the supporting member 15 carrying the shaver 3 in the direction X towards the cleaning liquid 13 in the container 11. FIG. 1 shows a further contact member 77 which is centrally provided in the container 11 and which opens the closing members 49 when the closing members 49 abut against the further contact member 77 during the displacement of the supporting member 15. As a result the cleaning liquid 13 will enter the receiving portion 39. FIG. 1 further shows a fluid sensor 79 which is able to detect the cleaning liquid 13. The fluid sensor 79 is mounted to the receiving portion 39. When during the displacement of the supporting member 15 from its first position towards the container 11 the fluid sensor 79 detects the cleaning liquid 13, the fluid sensor 79 supplies an electrical signal UFL to the control unit 73, and the control unit 73 stops the motor 23 of the displacing system 17. The position of the fluid sensor 79 relative to the receiving portion 39 is such that the supporting member 15 is displaced by the displacing system 17 from its first position to a second position in which the shaving head 7 is at least partially immersed in the cleaning liquid 13. For this purpose the fluid sensor 79 should be mounted a certain distance above the contact member 69. By using the fluid sensor 79 the second position of the supporting member 15 is automatically adapted to an actual level 81 of the cleaning liquid 13 in the container 11, so that in the second position of the supporting member 15 the shaving head 7 will always be immersed in the cleaning liquid 13 irrespective of the actual level 81. The actual level 81 may differ from the prescribed maximal level (the predefined level 47 in FIG. 1) as a result of evaporation of the cleaning liquid 13 or inaccurate filling by the user. It is noted that the expression "predefined level" used in the claims is not limited to said prescribed maximal level. Said predefined level may for example also refer to the level of an upper rim 83 of the container 11. It will be clear for the skilled person that in each embodiment of the invention the shaving head 7 will be at least partially below the upper rim 83 in the second position of the supporting member 15. It is further noted that instead of the fluid sensor 79 a fluid level sensor may be used which is mounted in a fixed position in the container 11 for detecting the actual level 81. In such an alternative embodiment the control unit 73 determines the second position of the supporting member 15 in dependence on the measured actual level 81.

After stopping the motor 23 of the displacing system 17, when the supporting member 15 has reached its second position and the shaving head 7 is immersed in the cleaning liquid 13, the control unit 73 activates the shaver 3. For this purpose the control unit 73 supplies an electrical signal $U_{ACT}$ to the shaver 3 via the electrical contact member 35. As a result the cutting units 51 of the shaving head 7 are activated. As a result of the rotational motion of the internal cutting members of the cutting units 51 an effective pumping action is achieved. As a result a flow of cleaning liquid 13 is generated via the hair entrance slits 57 of the external cutting members 53 into the shaving head 7. In the second position of the supporting member 15 the closing members 49 are held in their opened positions by means of the further contact member 77, and the exit openings 65 of the shaving head 7 are held in their exposed uncovered positions by the contact member 69. As a result said pumping action leads to a circulating flow of cleaning liquid 13 from the container 11 via the slits 57 into and through the shaving head 7, and from the shaving head 7 via the exit openings 65 back again into the container 11. Said flow of cleaning liquid 13 through the cutting units 51 and through the shaving head 7 provides an effective cleaning action for the cutting units 51 and the shaving head 7. In the container 11 dirt and debris released from the cutting units 51 and the shaving head 7 are effectively separated from the circulating flow of cleaning liquid 13 by sedimentation under the influence of gravity forces. As shown in FIG. 1 a bottom 85 of the container 11 comprises a sedimentation portion 87 with partition walls 89. The separated dirt and debris are accumulated between the partition walls 89, which prevent the accumulated dirt and debris from re-entering again in the circulating flow of cleaning liquid 13.

After a predetermined cleaning period the control unit 73 switches off the shaver 3 by supplying an electrical signal UOFF to the shaver 3 via the electrical contact member 35.

Subsequently the control unit 73 activates the motor 23 of the displacing system 17 to displace the supporting member 15 carrying the shaver 3 in the direction X' away from the container 11. During this displacement the closing members 49 automatically return into their closed positions again under the influence of the mechanical springs mentioned before. The control unit 73 stops the motor 23 when the supporting member 15 reaches its first position again. For this purpose, for example, the rectilinear guiding members 19, 21 are provided with a contact sensor, not shown in FIG. 1, for providing an appropriate electrical signal to the control unit 73.

When the supporting member 15 has reached its first position again, the shaving head 7 is above and out of contact with the cleaning liquid 13 again. As a result, in this position a drying process of the shaving head 7 can be started. In the embodiment shown in FIG. 1 the cleaning device 5 does not comprise any additional drying means. It appeared that an effective drying process is possible just by evaporation into the surrounding air of the cleaning liquid that remained behind in the cleaning head 7. Under normal circumstances, after a shave the user will leave the shaver 3 in the cleaning device 5 until a next shave, so that enough time is available for the evaporation process. Accordingly, when the user takes the shaver 3 away from the cleaning device 5 for the next shave the shaving head 7 will be both clean and dry. Since the cleaning device 5 has no additional drying means, the cleaning device 5 has a very simple structure. The simple structure of the cleaning device 5 is also a result of the fact that the cleaning device 5 does not have a pumping or other kind of transport system for the cleaning liquid 13. Furthermore the absence of a pumping system considerably reduces the risk of obstructions in the cleaning device 5 by accumulating dirt and debris and the risk of leakages of the cleaning liquid 13. As a result the chance of malfunction of the cleaning device 5 is considerably reduced. Furthermore the displacement of the shaver 3 by the displacing system 17 and the position of the shaver 3 relative to the container 11 provide the user with a visual indication of the progress of the cleaning action.

Figure 4:
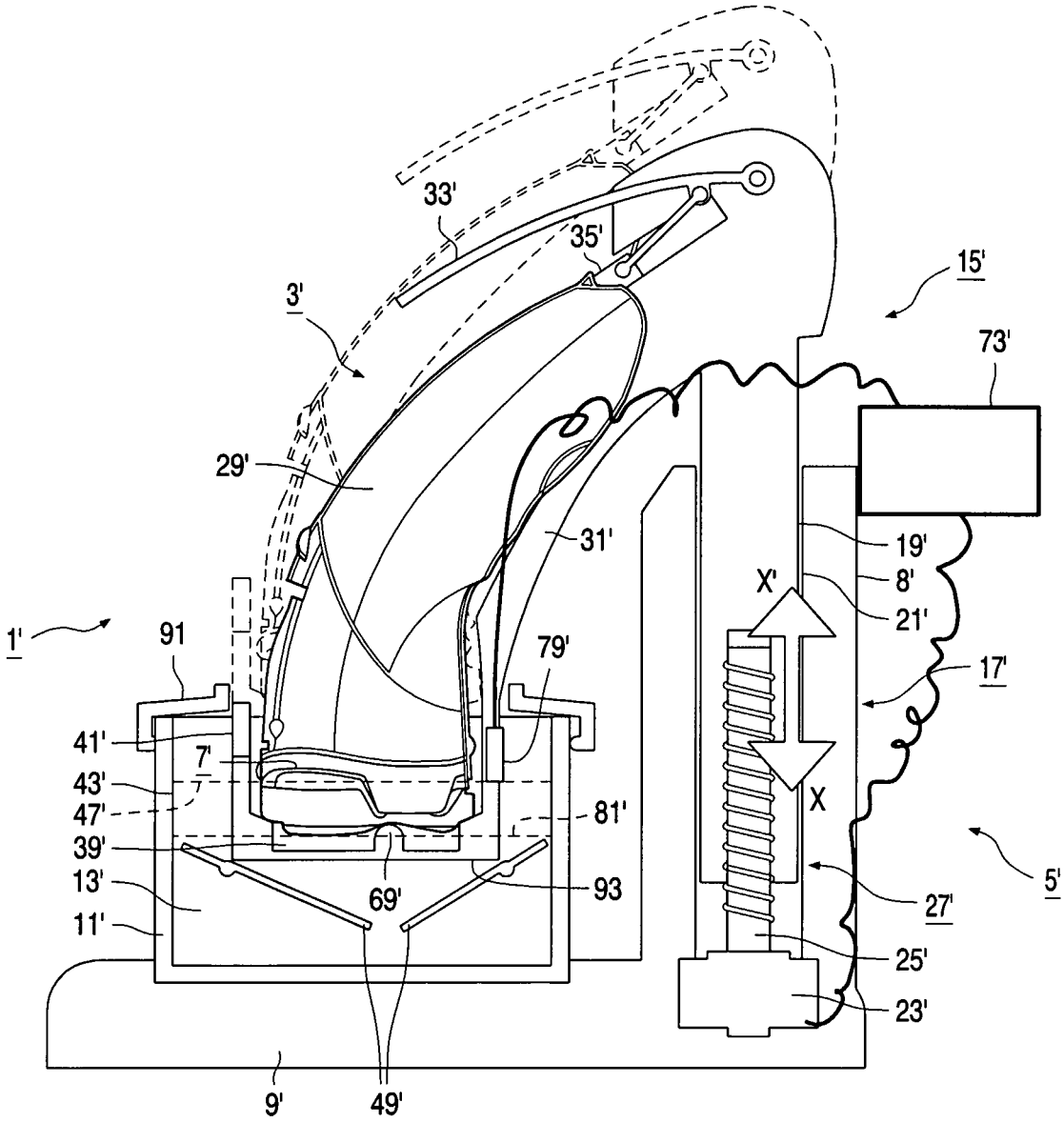
FIG. 4 shows a second embodiment of a personal care system according to the invention.

FIG. 4 shows a second embodiment of a personal care system 1' according to the invention. In FIG. 4 parts of the personal care system 1', which correspond with parts of the personal care system 1 described before, are indicated with corresponding reference numbers. In the following only the main differences between the personal care system 1' and the personal care system 1 are discussed. FIG. 4 shows the supporting member 15' of the cleaning device 5' in a position between its first and second positions. In FIG. 4 the first position of the supporting member 15' is indicated by broken lines.

The main difference between the personal care system 1' and the personal care system 1 is that in the cleaning device 5' of the personal care system 1' the closing members 49' are pivotably mounted to the container 11'. In their closed positions the closing members 49' alone completely close the container 11'. As a result the cleaning device 5' does not need to have an additional sealing, like the small gap present between the circumferential wall 41 of the receiving portion 39 and the inner wall 43 of the container 11 in the cleaning device 5 of the personal care system 1, to prevent the escape of cleaning-liquid vapor along the space present between the inner wall 43' of the container 11' and the circumferential wall 41' of the receiving portion 39'. FIG. 4 shows a closing lid 91 provided on the container 11', but it is noted that said closing lid 91 has no sealing function. In the first position of the supporting member 15' the closing members 49' are held in their closed positions by mechanical springs not shown in FIG. 4 for the sake of simplicity. When the container 15' is displaced from its first to its second position, as shown in FIG. 4, the closing members 49' are opened by abutment of a bottom portion 93 of the receiving portion 39' against the closing members 49'. An additional advantage of the closing members 49' is that in the first position of the supporting member 15' the container 11' can be removed from the cleaning device 5' in an easier manner in view of the absence of a sealing between the container 11' and the receiving portion 39'.

Figure 5:
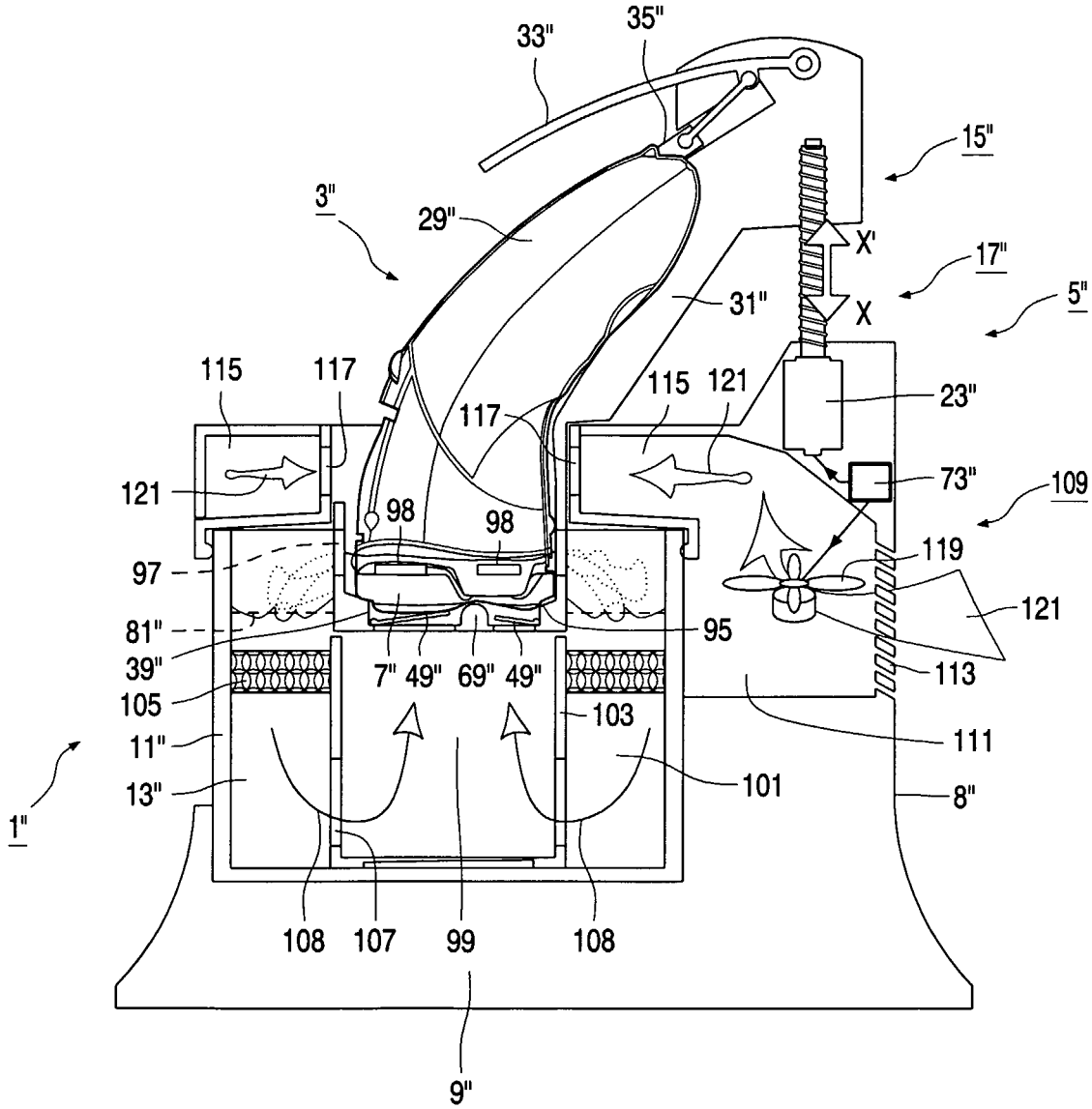
FIG. 5 shows a third embodiment of a personal care system according to the invention.

FIG. 5 shows a third embodiment of a personal care system 1" according to the invention. In FIG. 5 parts of the personal care system 1", which correspond with parts of the personal care system 1 described before, are indicated with corresponding reference numbers. In the following only the main differences between the personal care system 1" and the personal care system 1 are discussed. FIG. 5 shows the supporting member 15" of the cleaning device 5" in its second position.

In the cleaning device 5" of the personal care system 1", like in the cleaning device 5 of the personal care system 1, the closing members 49" are pivotably mounted to the receiving portion 39", wherein in the first position of the supporting member 15" the closing members 49" are held in their closed positions by means of mechanical springs not shown in FIG. 5 for the sake of simplicity. For the sake of simplicity FIG. 5 does not show the further contact member which holds the closing members 49" in their opened positions in the second position of the supporting member 15". The receiving portion 39" comprises a sealing member 95 on which a circumferential portion of the shaving head 7" rests when the shaving head 7" is accommodated in the receiving portion 39". The receiving portion 39" further comprises a number of openings 97 which are provided above the sealing member 95. The shaving head 7" comprises a number of exit openings 98 for the cleaning liquid 13" which are provided on a stationary housing portion of the shaving head 7". The container 11" has a central portion 99 and a by-pass portion 101 which is separated from the central portion 99 by an annular separation wall 103. The by-pass portion 101 comprises an annular filter element 105. The by-pass portion 101 is connected to the central portion 99 via openings 107 provided in the separation wall 103 at locations below the filter element 105.

When the shaver 3" is activated by the control unit 73" in the second position of the supporting member 15", a circulating flow 108 of cleaning liquid 13" is generated by the cutting units of the shaver 3" from the central portion 99 along the opened closing members 49" into the shaving head 7", from the shaving head 7" via the exit openings 98 and the openings 97 into the by-pass portion 101, and from the by-pass portion 101 via the filter element 105 back again into the central portion 99. A leakage or flow of cleaning liquid 13" from the exit openings 98 directly towards the central portion 99 is prevented by the sealing member 95. Dirt and debris released from the shaving head 7" by the circulating flow 108 of cleaning liquid 13" are mainly accumulated in the filter element 105, which is exchangeably provided in the container 11".

The cleaning device 5" of the personal care system 1" further comprises an air flow generating system 109 comprising an air flow channel 111 having an air inlet 113 and an annular air outlet portion 115. The air inlet 113 is provided in the housing 8". The air outlet portion 115 surrounds the receiving portion 39" when the supporting member 15" is in its first position. In this position the openings 97 provided in the receiving portion 39" oppose openings 117 provided in the air outlet portion 115. An electrical fan unit 119 is provided in the air flow channel 111 to generate an air flow 121 from the air inlet 113 towards the air outlet portion 115 and further through the receiving portion 39" when the supporting member 15" is in its first position. During operation of the cleaning device 5" the fan unit 119 is activated by the control unit 73" after the supporting member 15" has been displaced back from its second position (shown in FIG. 5) into its first position by the displacing system 17". In this manner the shaving head 7" is effectively dried in a relatively short period of time after being cleaned.

It is noted that a personal care system in accordance with the invention may comprise a different kind of electrical shaver than the shaver 3, 3', 3" with the rotating cutting units 51 described before. A personal care system in accordance with the invention may for example also comprise an electrical shaver with a stationary external cutting member or blade and an internal cutting member which is reciprocatable relative to the external cutting member. Although such an alternative shaver does not provide a pumping effect which is as effective as the pumping effect of the shaver 3, 3', 3", the reciprocating motion of the internal cutting member of such an alternative shaver does provide a sufficient cleaning action for at least the cutting members of the alternative shaver when the shaving head is immersed in the cleaning liquid.

In each embodiment of a cleaning device 5, 5', 5" in accordance with the invention described before the supporting member 15, 15', 15" comprises a receiving portion 39, 39', 39" which accommodates the shaving head 7, 7', 7" when the shaver 3, 3', 3" is properly supported by the supporting member 15, 15', 15". It is noted, however, that the invention also covers embodiments of a cleaning device in which the supporting member does not have such a receiving portion, but in which the shaving head is not materially surrounded or partially surrounded by a receiving portion of the supporting member. In all such alternative embodiments, however, the supporting member defines a receiving space in which the shaving head is present when the shaver is properly supported by the supporting member. An additional advantage of such an alternative embodiment is that the drying process of the shaving head is considerably accelerated as a result of the fact that in the first position of the supporting member the shaving head is not materially surrounded by a receiving portion, so that the escape of cleaning-liquid vapor from the shaving head is not obstructed by the receiving portion.

It is further noted that the invention is not limited to embodiments of a cleaning device in which the supporting member comprises a holder for receiving and holding a housing or a grip portion of the shaver, like the supporting members 15, 15' and 15" of the cleaning devices 5, 5' and 5" described before. For example, the invention also covers embodiments in which the supporting member supports the shaver by supporting solely the shaving head of the shaver. In such an alternative embodiment the shaver is for example supported and held in position by the receiving portion which accommodates the shaving head. An advantage of such an alternative embodiment is that the cleaning device has a more compact structure with in particular a reduced height.

In each embodiment of a cleaning device 5, 5', 5" in accordance with the invention described before the supporting member 15, 15', 15" is rectilinearly displaceable by the displacing system 17, 17', 17" in a vertical or approximately vertical direction X, X' from the first position, in which the shaving head 7, 7', 7" is above the predefined level 47 of the cleaning liquid 13 in the container 11, to the second position, in which the shaving head 7, 7', 7" is at least partially below said predefined level 47. It is noted that the invention also covers embodiments in which the supporting member is displaceable along a different path by the displacing system, and said path may also be curved. The invention also covers embodiments in which, in the first position of the supporting member, the shaving head is out of the container but at a vertical level below the level of the cleaning liquid in the container. The supporting member may for example be displaceable along a semi-circular path from a first position, in which the shaving head is positioned at the side of the container, to said second position.

In a special embodiment, when in operation the shaver is supported by the supporting member, the supporting member is displaced in such a manner that in the first position of the supporting member the shaver is in a substantially upright position, and in the second position of the supporting member the shaver is in a rotated position relative to its upright position wherein the shaving head is directed in a downward or approximately downward direction so as to be at least partially immersed in the cleaning liquid. In this special embodiment, the displacing system may be a simple rotational system causing a displacement of the supporting member with the shaver from its first position into its second position via a rotational motion. Also other types of displacing systems may be used causing, for example, a combined linear and rotational motion of the supporting member. With respect to this special embodiment, said upright position of the shaver is the position in which the shaver is normally held by the user during shaving and just before and after shaving, wherein the shaving head is in an upwardly or approximately upwardly directed position. An advantage of this special embodiment is that, when the supporting member is in its first position before or after cleaning of the shaving head, the shaving head is visible for the user, so that the user can inspect the shaving head, for example, after cleaning thereof. Another advantage is that, when the shaver comprises a display, said display will be in an upright position in the first position of the supporting member, so that the display can easily be read by the user. In this special embodiment, after cleaning of the shaving head in the second position and before being displaced into its first position again, the supporting member may first be displaced from the second position into a third position between the second position and the first position. In said third position, the shaver is for example in an approximately horizontal position, so that the shaving head is above the cleaning liquid. In said third position of the supporting member, cleaning liquid remaining in the shaving head after cleaning is allowed to drip out of the shaving head back into the container.

It is further noted that the invention also covers embodiments in which during operation the supporting member carrying the shaver is successively displaced by the displacing system from the first position into two or even more than two mutually different positions in which the shaving head is in contact with the cleaning liquid in the container. An example is an embodiment wherein the supporting member is first displaced from the first position into a second position, in which the shaving head is completely or for the greater part immersed in the cleaning liquid and in which the shaver is not activated, and subsequently from said second position into a third position, in which the shaving head is partially immersed in the cleaning liquid and in which the shaver is activated. In this embodiment said second position is used to soak or soften the dirt and debris present in the shaving head, so that in the following third position the dirt and debris will better be transported out of the shaving head by the flow of cleaning liquid through the shaving head.

It is finally noted that a cleaning device in accordance with the invention may have additional functions. The cleaning device may for example comprise an electrical charging function to charge a rechargable battery of the shaver after cleaning and/or drying the shaver. The cleaning device may for example have a display providing the user with information about the shaver when the shaver is present in the cleaning device. The display may for example indicate the progress of the cleaning and/or drying action or the state of charge of the battery of the shaver.

The invention claimed is:

1. A personal care system comprising an electrical shaver and a cleaning device for cleaning a shaving head of the shaver, the shaving head having a carrying member wherein the cleaning device comprises:

a container for a cleaning liquid; and a supporting member for supporting the shaver in a first position and a second position; and a displacing system configured to displace the supporting member relative to the container from the first position in which the shaving head, when the shaver is supported by the supporting member, is not in contact with the cleaning liquid in the container, to the second position in which the shaving head, when the shaver is supported by the supporting member, is at least partially immersed in the cleaning liquid in the container, wherein the container comprises a contact member which protrudes from a container surface of the container to a position higher than remaining portions of the container surface for making a contact at a contact location that abuts against an inner portion of the carrying member for pushing the inner portion of the carrying member inward away from the container surface to tilt the carrying member so that a circumferential portion of the carrying member is moved towards the container surface, wherein the inner portion is away from the circumferential portion towards a central portion of the carrying member.

2. The personal care system as claimed in claim 1, wherein in said first position, the shaving head is above a predefined level of cleaning liquid in the container, and in said second position the shaving head is at least partially below said predefined level.

3. The personal care system as claimed in claim 1, wherein the shaving head comprises at least one cutting unit having an external cutting member and an internal cutting member which is rotatable relative to the external cutting member by an electrical driving unit.

4. The personal care system as claimed in claim 1, wherein the shaving head comprises at least one exit opening for the cleaning liquid.

5. The personal care system as claimed in claim 4, wherein the shaving head further comprises at least one cutting unit which is carried by a carrying member which is movable relative to the shaving head from a first position into a second position, wherein the carrying member comprises the exit opening, and wherein the exit opening is in a retracted covered position relative to the shaving head in said first position of the carrying member and in an exposed uncovered position relative to the shaving head in said second position of the carrying member.

6. The personal care system as claimed in claim 5, wherein the supporting member comprises a receiving portion for accommodating the shaving head when the shaver is supported by the supporting member, said receiving portion having a contact member for holding the carrying member in its second position when the shaving head is accommodated in the receiving portion.

7. The personal care system as claimed in claim 1, wherein the cleaning device further comprises a closing member for closing the container at least in the first position of the supporting member.

8. The personal care system as claimed in claim 7, wherein in the first position of the supporting member the closing member is held in a closed position by a mechanical spring, and wherein in the second position of the supporting member the closing member is held in an opened position by a contact member.

9. The personal care system as claimed in claim 1, the cleaning device further comprises a fluid sensor for detecting the cleaning liquid.

10. The personal care system as claimed in claim 9, wherein the supporting member comprises a receiving portion for accommodating the shaving head when the shaver is supported by the supporting member, wherein the fluid sensor is mounted to the receiving portion.

11. The personal care system as claimed in claim 1, wherein the container comprises a bottom having a sedimentation portion with partition walls.

12. The personal care system as claimed in claim 1, wherein the supporting member comprises a holder for receiving and holding a housing or a grip portion of the shaver.

13. The personal care system as claimed in claim 1, wherein the supporting member defines a receiving space for accommodating the shaving head when the shaver is supported by the supporting member, and wherein the cleaning device further comprises an air flow generating system for generating an air flow in the receiving space in the first position of the supporting member.

14. The personal care system as claimed in claim 1, wherein the cleaning device further comprises an electrical control unit for activating, after activation of the cleaning device by a user, the displacing system to displace the supporting member from the first position into the second position, for subsequently, after a predetermined cleaning period, activating the displacing system to displace the supporting member from the second position back into the first position, and for activating the shaver at least in the second position of the supporting member.

15. An electrical shaver suitable for use in a personal care system as claimed in claim 1, the shaver comprising a shaving head which comprises at least one cutting unit, said cutting unit being carried by a carrying member which is movable relative to the shaving head from the first position into the second position, wherein the carrying member comprises an exit opening for a cleaning liquid, wherein the exit opening is in a retracted covered position relative to the shaving head in said first position of the carrying member and in an exposed uncovered position relative to the shaving head in said second position of the carrying member.

16. The personal care system of claim 1, wherein the displacing system comprises a motor configured to displace the supporting member relative to the container between the first position and the second position.

17. The personal care system of claim 16, wherein the displacing system further comprises transmission system for converting a rotational motion of the motor into a rectilinear motion of the supporting member along a guiding member.

18. A cleaning device suitable for use in a personal care system having a carrying member, the cleaning device comprising:

a container for a cleaning liquid;

a supporting member for supporting an electrical shaver in a first position and a second position; and a displacing system configured to displace the supporting member relative to the container from the first position in which the shaving head, when the shaver is supported by the supporting member, is not in contact with the cleaning liquid in the container, to the second position in which the shaving head, when the shaver is supported by the supporting member, is at least partially immersed in the cleaning liquid in the container, wherein the container comprises a contact member which protrudes from a container surface of the container to a position higher than remaining portions of the container surface for making a contact at a contact location that and abuts against an inner portion of the carrying member for pushing the inner portion of the carrying member inward away from the container surface to tilt the carrying member so that a circumferential portion of the carrying member is moved towards the container surface, wherein the inner portion is away from the circumferential portion towards a central portion of the carrying member.

* * * * *